US010865754B2

(12) United States Patent
Lopez et al.

(10) Patent No.: US 10,865,754 B2
(45) Date of Patent: Dec. 15, 2020

(54) FUEL INJECTOR HAVING NEEDLE TIP AND NOZZLE BODY SURFACES STRUCTURED FOR REDUCED SAC VOLUME AND FRACTURE RESISTANCE

(71) Applicant: Progress Rail Services Corporation, Albertville, AL (US)

(72) Inventors: Rolando Lopez, Lehigh Acres, FL (US); Randall Gunderson, Minooka, IL (US)

(73) Assignee: Progress Rail Services Corporation, Albertville, AL (US)

( * ) Notice: Subject to any disclaimer, the term of this patent is extended or adjusted under 35 U.S.C. 154(b) by 328 days.

(21) Appl. No.: 15/479,897

(22) Filed: Apr. 5, 2017

(65) Prior Publication Data

US 2018/0291854 A1 Oct. 11, 2018

(51) Int. Cl.
*F02M 61/18* (2006.01)

(52) U.S. Cl.
CPC ..... *F02M 61/1886* (2013.01); *F02M 61/1873* (2013.01)

(58) Field of Classification Search
CPC ..... F02M 61/1886; F02M 61/1873; F02M 61/18; F02M 61/188; F02M 63/0031; F02M 63/0033; F02M 63/0035; F02M 63/0036; F02M 61/1806; F02M 61/1893
USPC ..... 239/533.9
See application file for complete search history.

(56) References Cited

U.S. PATENT DOCUMENTS

| | | | | |
|---|---|---|---|---|
| 3,836,080 | A | 9/1974 | Butterfield et al. | |
| 4,229,148 | A * | 10/1980 | Richmond | F02M 41/12 123/495 |
| 5,746,376 | A * | 5/1998 | Romann | F02M 51/061 239/585.4 |
| 5,954,033 | A | 9/1999 | Moncelle | |
| 6,491,237 | B1 | 12/2002 | Coppola et al. | |
| 6,776,353 | B2 | 8/2004 | Moorthy et al. | |
| 6,966,499 | B2 | 11/2005 | Nally et al. | |
| 7,134,615 | B2 | 11/2006 | Lawrence | |
| 8,002,205 | B2 | 8/2011 | Lambert et al. | |
| 8,905,333 | B1 | 12/2014 | Sykes et al. | |
| 9,371,808 | B2 * | 6/2016 | Hashii | F02M 61/186 |
| 9,546,633 | B2 | 1/2017 | Bandyopadhyay et al. | |

(Continued)

FOREIGN PATENT DOCUMENTS

| | | | |
|---|---|---|---|
| DE | 102015211769 | * 12/2016 | F02M 51/06 |
| JP | 2007224746 A | 9/2007 | |
| WO | 2016099507 | 6/2016 | |

*Primary Examiner* — Viet Le
*Assistant Examiner* — Christopher R Dandridge
(74) *Attorney, Agent, or Firm* — Brannon Sowers & Cracraft

(57) ABSTRACT

A nozzle assembly for a fuel injector includes a nozzle body and a needle tip positioned within the nozzle body. The needle check includes a terminal end surface positioned in spaced, facing relation to a sac surface of the nozzle body, to form a sac cavity. The terminal end surface and sac surface each have spherical shapes, and are centered about a longitudinal axis of the nozzle body. Structures of the terminal end surface and the sac surface are such that a clearance between them is nowhere less than along a line segment between centers of the terminal end surface and the sac surface, the sac cavity has a reduced volume, and wall thickness at the nozzle tip is sufficient for improved fracture resistance.

18 Claims, 3 Drawing Sheets

(56) References Cited

U.S. PATENT DOCUMENTS

| | | | | |
|---|---|---|---|---|
| 2007/0012805 | A1* | 1/2007 | Maier | F02M 61/1833 239/533.12 |
| 2011/0073683 | A1* | 3/2011 | Hashii | F02M 61/188 239/548 |
| 2012/0180757 | A1* | 7/2012 | Gerber | F02M 61/1886 123/294 |
| 2015/0020778 | A1* | 1/2015 | Upadhye | F02M 61/10 123/456 |

* cited by examiner

FUEL INJECTOR HAVING NEEDLE TIP AND NOZZLE BODY SURFACES STRUCTURED FOR REDUCED SAC VOLUME AND FRACTURE RESISTANCE

TECHNICAL FIELD

The present disclosure relates generally to a nozzle assembly in a fuel injector, and more particularly to a needle check and nozzle body where opposed surfaces of the needle check and nozzle body are structured to reduce sac volume and provide enhanced nozzle body structural integrity.

BACKGROUND

Fuel injectors have been used in a great many different types of internal combustion engines for over a century. In many modern designs, a valve member commonly referred to as an outlet check is positioned within a fuel injector body, and controlled to selectively connect high pressure fuel in an external fuel supply, or an internal fuel passage or plunger chamber within the injector body, with fuel spray orifices in fluid communication with a combustion chamber. Engineers have developed virtually innumerable different designs for such outlet checks, valve seats that shut off fuel injection when contacted by an outlet check, as well as surface shapes and flow strategies for fuel within a fuel injector. The size and shape of the fuel spray orifices themselves have also been the focus of significant engineering efforts. Fuel spray orifices having outwardly narrowed shapes, outwardly widening "trumpet" shapes, and still others have been proposed. A great many different geometries are known for the shapes and configurations of orifice plates, cavities, and still other fuel injector features.

It has also been discovered that tailoring the manner in which fuel exits a fuel injector tip, as well as the manner and structures by which fuel flow is initiated and terminated, can have significant effects on efficiency and an emissions profile of an engine. Fuel that dribbles off an injector tip past the point in time at which injection is intended to cease can be expected to poorly combust, if at all. Fuel spray impinging the cylinder bore walls likewise will tend to cool rapidly and burn less completely or less efficiently than what might otherwise be obtained. Fuel that remains resident within a fuel injector nozzle in the so-called "sac" after terminating injection has been observed to have a significant effect on properties of engine emissions and efficiency. Completely eliminating such residual fuel, however, can be undesired for a variety of reasons, including the likely loss of a cooling effect of the residual fuel on fuel nozzle components. These and other phenomena have driven decades of research and development in the fuel systems field, resulting in many different strategies employed by numerous different manufacturers over the years.

U.S. Pat. No. 6,491,237 is directed to a fuel injector that purportedly minimizes sac volume and tends to reduce undesired vortices in the flow of fuel. A closure member having a generally spherical tip is provided for such purposes.

SUMMARY OF THE INVENTION

In one aspect, a nozzle assembly for a fuel injector includes a nozzle body defining a longitudinal axis, and having an outer surface, an inner surface, and a dome-shaped nozzle tip, and having formed therein a nozzle outlet passage. The inner surface includes a seat surface extending circumferentially around the longitudinal axis and located axially inward of the dome-shaped nozzle tip, and a sac surface located at least predominantly within the dome-shaped nozzle tip. The dome-shaped nozzle tip has formed therein a plurality of spray orifices distributed about the longitudinal axis and extending from a plurality of inlet locations within the sac surface to a plurality of outlet locations within the outer surface. The nozzle assembly further includes a needle check positioned for reciprocation within the nozzle body and defining an axis of reciprocation that is collinear with the longitudinal axis, the needle check having a first end that includes a closing hydraulic surface and an opening hydraulic surface, and a second end that includes a needle tip having a sealing surface and a terminal end surface located axially outward of the sealing surface. The sealing surface is positioned in contact with the seat surface such that the needle check blocks the nozzle outlet passage from fluid communication with the plurality of spray orifices, and the terminal end surface is positioned in spaced, facing relation to the sac surface, such that a sac cavity extends between the needle check and the nozzle body. The terminal end surface has a spherical shape that curves according to a convex radius of curvature, and the sac surface has a spherical shape that curves according to a concave radius of curvature. Each of the terminal end surface and the sac surface is centered about the longitudinal axis, and the convex radius of curvature and the concave radius of curvature are sized such that a clearance between the terminal end surface and the sac surface is nowhere less than along a line segment that extends between the terminal end surface and the sac surface and is collinear with the longitudinal axis.

In another aspect, a fuel injector for an internal combustion engine includes a nozzle body defining a longitudinal axis and having formed therein a plurality of spray orifices, and a nozzle outlet passage extending between the fuel inlet and the plurality of spray orifices. The fuel injector further includes an injection control mechanism having a needle check positioned for reciprocation within the nozzle body. The nozzle body has an outer surface, an inner surface, and a dome-shaped nozzle tip centered about the longitudinal axis. The inner surface includes a seat surface extending circumferentially around the longitudinal axis and located axially inward of the dome-shaped nozzle tip, and a sac surface located at least predominantly within the dome-shaped nozzle tip and centered about the longitudinal axis. The plurality of spray orifices are formed within the dome-shaped nozzle tip and extend from a plurality of inlet locations within the sac surface to a plurality of outlet locations within the outer surface. The needle check has a first end, and a second end that includes a needle tip having a sealing surface and a terminal end surface located axially outward of the sealing surface. The sealing surface is positioned in contact with the seat surface such that the needle check blocks the nozzle outlet passage from fluid communication with the plurality of spray orifices, and the terminal end surface is positioned in spaced, facing relation to the sac surface, such that a sac cavity extends between the needle check and the nozzle body. The terminal end surface has a spherical shape that curves according to a convex radius of curvature, and the sac surface has a spherical shape that curves according to a concave radius of curvature. A clearance extends between the terminal end surface and the sac surface, and the clearance has a size throughout the sac cavity that is equal to or greater than a size of the clearance along a line segment that is collinear with the longitudinal axis.

In still another aspect, a fuel system for an internal combustion engine includes a fuel supply, and at least one fuel pressurization mechanism coupled with the fuel supply. The fuel system further includes a plurality of fuel injectors coupled with the at least one fuel pressurization mechanism, and each having a nozzle body defining a longitudinal axis and having formed therein a plurality of spray orifices, and a nozzle outlet passage extending between the fuel inlet and the plurality of spray orifices. The fuel system further includes an injection control mechanism having a needle check positioned for a reciprocation within the nozzle body, and the nozzle body having an outer surface, an inner surface, and a dome-shaped nozzle tip centered about the longitudinal axis. The inner surface includes a seat surface extending circumferentially around the longitudinal axis and located axially inward of the dome-shaped nozzle tip, and a sac surface located at least predominantly within the dome-shaped nozzle tip and centered about the longitudinal axis. The plurality of spray orifices are formed within the dome-shaped nozzle tip and extend from a plurality of inlet locations within the sac surface to a plurality of outlet locations within the outer surface. The needle check has a first end, and a second end that includes a needle tip having a sealing surface and a terminal end surface located axially outward of the sealing surface. The sealing surface is positionable in contact with the seat surface such that the needle check blocks the nozzle outlet passage from fluid communication with the plurality of spray orifices, and the terminal end surface being positionable in spaced, facing relation to the sac surface, such that a sac cavity extends between the needle check and the nozzle body, when the needle check blocks the nozzle outlet passage. The terminal end surface has a spherical shape that curves according to a convex radius of curvature, and the sac surface having a spherical shape that curves according to a concave radius of curvature. A clearance extends between the terminal end surface and the sac surface, and the clearance having a size throughout the sac cavity that is equal to or greater than a size of the clearance along a line segment that is collinear with the longitudinal axis.

DETAILED DESCRIPTION

Figure 1:
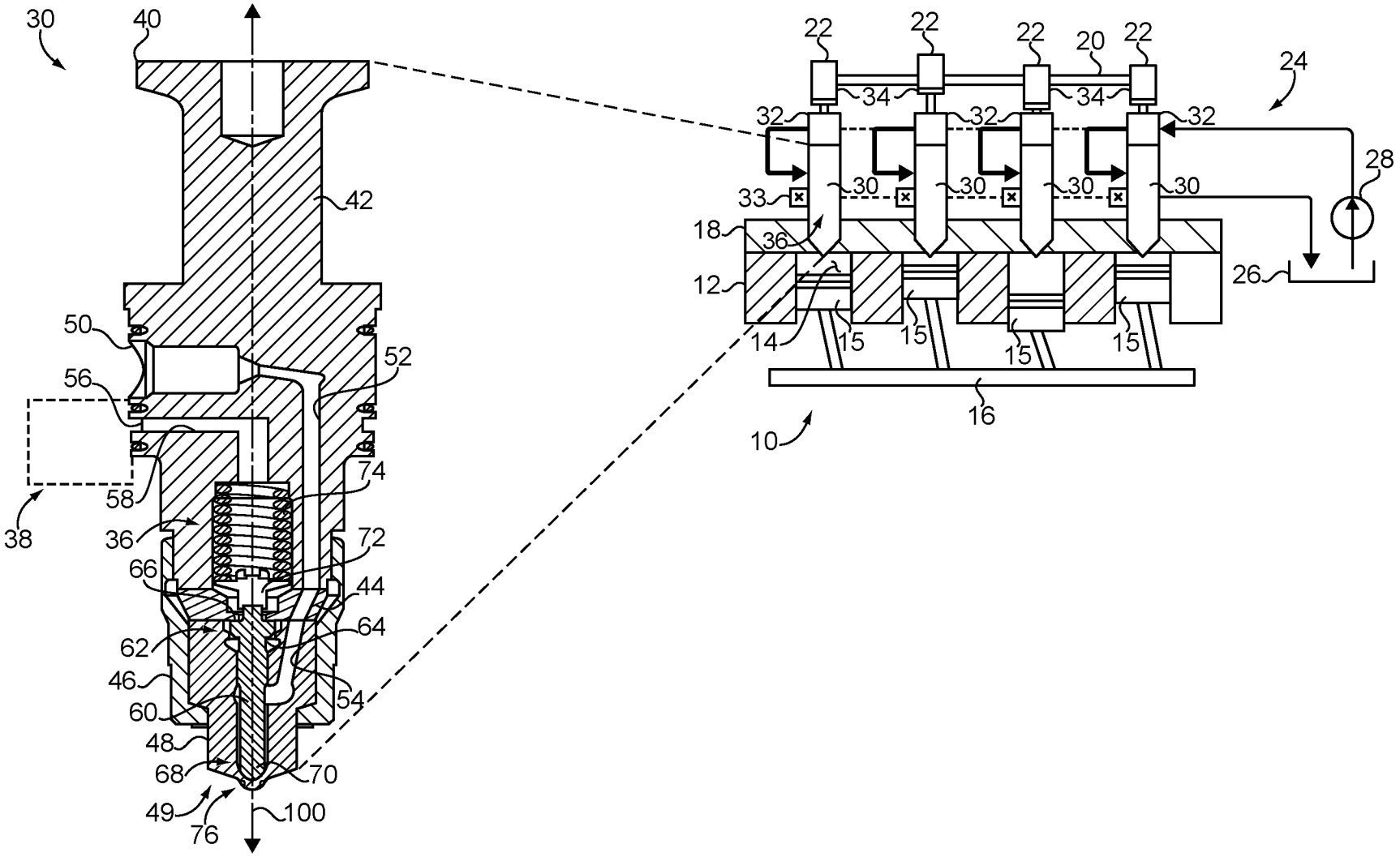
FIG. 1 is a partially sectioned side diagrammatic view of an engine system, including a detailed enlargement, according to one embodiment.

Referring to FIG. 1, there is shown an internal combustion engine system 10 including an engine housing 12 having a plurality of cylinders 14 formed therein. A plurality of pistons 15 are positioned to reciprocate one within each of the plurality of cylinders 14 in a generally conventional manner, and are coupled with an engine crankshaft 16. Internal combustion engine system 10 (hereinafter "engine system 10") may include a direct injected compression ignition diesel engine where cylinders 14 are arranged in an in-line configuration, a V-configuration, or any other suitable configuration, and having a number of cylinders equal to 12, 16, or any other suitable number.

Engine system 10 further includes a fuel system 24, having a fuel supply or tank 26, and a fuel pump 28 structured to convey fuel from fuel tank 26 to a plurality of fuel injectors 30 each supported within an engine head 18 and positioned at least partially within one of the plurality of cylinders 14. In an implementation, at least one fuel pressurization mechanism is positioned fluidly between fuel tank 26 and fuel injectors 30. The at least one fuel pressurization mechanism can include a plurality of unit pumps 32 coupled one with each of fuel injectors 30. Unit pumps 32 may each include a tappet 34 that is in contact with one of a plurality of cams 22 upon a camshaft 20 rotatable by way of operation of engine system 10 in a generally conventional manner. A plunger in each unit pump 32 can be driven by tappet 34. In other embodiments, rather than unit pumps a common rail or the like could be used. Fuel pump 30 could serve as the fuel pressurization mechanism in a common rail embodiment. Each fuel injector 30 further includes an injection control mechanism 36 which can include a valve assembly 38 that is part of or coupled with the corresponding fuel injector 30, and controls fuel injection as further discussed herein.

FIG. 1 also includes a detailed enlargement of certain components of one of fuel injectors 30. As fuel injectors 30 may be substantially identical to one another, the description of the one fuel injector 30 and illustration in FIG. 1 should be understood to refer analogously to any of the other fuel injectors 30 of engine system 10. Fuel injector 30 includes an injector body 40 structured to couple with engine head 18, and having an upper body piece 42, a middle body piece 44, and a clamping body piece 46. Injector body 40 also includes a nozzle body 48 defining a longitudinal axis, and clamped against middle body piece 44 by way of engagement, such as a threaded engagement, of clamping body piece 46 and upper body piece 42. Upper body piece 40 defines an inlet 50 structured to receive fuel pressurized by way of the operation of the corresponding fuel pressurization mechanism or unit pump 32. A nozzle supply passage 52 extends between inlet 50 and a nozzle outlet passage 54 formed in nozzle body 48. A plurality of spray orifices 76 are selectively connectable with nozzle outlet passage 54 in a manner further described herein.

Upper body piece 40 further defines an outlet 56 fluidly connected to a valve assembly 38 of injection control mechanism 36. Valve assembly 38 can operate to selectively connect outlet 56 and a drain passage 58 to a low-pressure space, controlling a timing, a duration, and in some instances a rate shape of fuel injection in a generally known manner. Injection control mechanism 36 further includes a needle check 60 positioned for reciprocation within nozzle body 48, and defining an axis of reciprocation (not numbered) that is collinear with longitudinal axis 100. Needle check 60 may include a first end 62 that has an opening hydraulic surface 64 and a closing hydraulic surface 66 and a second end 68 that includes a needle tip 70. A biasing spring 74 is positioned within injector body 40 and biases needle check 60 towards a closed position blocking fluid communication between nozzle outlet passage 54 and spray orifices 76.

Figure 2:
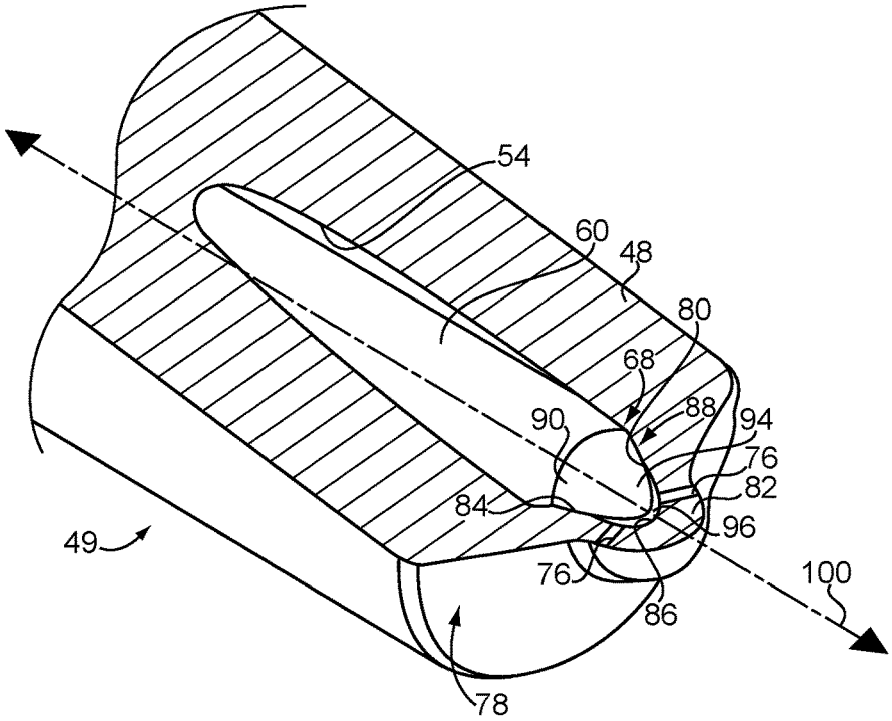
FIG. 2 is a cutaway view of a nozzle assembly, according to one embodiment.

Referring also now to FIG. 2, there is shown a nozzle assembly 49 of nozzle body 48 and needle check 60, illustrating certain features in additional detail. As noted above, nozzle body 48 defines a longitudinal axis 100, with certain other components of fuel injector 30 being centered upon and/or arranged about longitudinal axis 100. Nozzle body 48 further includes an outer surface 78, an inner surface 80, and a dome-shaped nozzle tip 82. Inner surface 80 includes a seat surface 84 extending circumferentially about longitudinal axis 100 and located axially inward of dome-shaped nozzle tip 82. Seat surface 84 may have a conical shape. Inner surface 80 further includes a sac surface 86 located at least predominantly within dome-shaped nozzle tip 82. Spray orifices 76, which may number 3, 4, 5, 6, or another number, are formed in dome-shaped nozzle tip 82 (hereinafter "tip 82") and are distributed about longitudinal axis 100 in a generally regular circumferential distribution. Spray orifices 76 extend from a plurality of inlet locations within sac surface 86 to a plurality of outlet locations within outer surface 78. Sac surface 86 may be partially or entirely inclusive of the inlet locations of spray orifices 76. In other words, an entirety of an "inlet" to each spray orifice may be surrounded by sac surface 86 or, alternatively, sac surface 86 might extend axially inward only enough to surround a part of each spray orifice 76. In either case, inlet locations associated with spray orifices 76 would be considered within sac surface 86. A transition surface (not numbered) that is neither spherical nor conical in shape may extend between sac surface 86 and seat surface 84.

In FIG. 2 needle check 60 is shown as it might appear in a closed position, blocking fluid communication between nozzle outlet passage 54 and spray orifices 76, and biased toward the closed position by way of a spring 74. Valve assembly 38 can be operated to relieve hydraulic pressure acting upon closing hydraulic surface 66, and/or upon a needle control piece 72 coupled between spring 74 and needle check 60, to enable hydraulic pressure of fuel acting upon opening hydraulic surface 64, and potentially other opening hydraulic surfaces of needle check 60, to lift needle check 60 and initiate fuel injection. Valve assembly 38 can also be operated to block drain passage 58 from low pressure and enable a combination of force from biasing spring 60 and hydraulic pressure acting on closing hydraulic surface 66 and/or needle control piece 72 to urge needle check 60 back towards a closed position to terminate a fuel injection event. Needle control piece 72 could be considered a part of needle check 60 and injection control mechanism 36 in at least some instances. Needle check 60 may include a second end 68 as noted above, that includes a needle tip 88 having a sealing surface 90 and a terminal end surface 94 located axially outward of and typically but not necessarily adjoining sealing surface 90. At the closed position of needle check 60, approximately as depicted in FIG. 2, sealing surface 90 is positioned in contact with seat surface 84 such that needle check 60 blocks nozzle outlet passage 54 from fluid communication with spray orifices 76 as described herein. Seat surface 90 may have a conical shape, although the present disclosure is not thereby limited. Terminal end surface 94 may be positioned in spaced, facing relation to sac surface 86, such that a sac cavity 96 extends between needle check 60 and nozzle body 48. As will be further apparent from the following description, a size and shape of sac cavity 96 provides advantages over certain known designs, particularly with respect to efficiency and resistance of nozzle body 48 to certain types of fatigue or structural failure.

Figure 3:
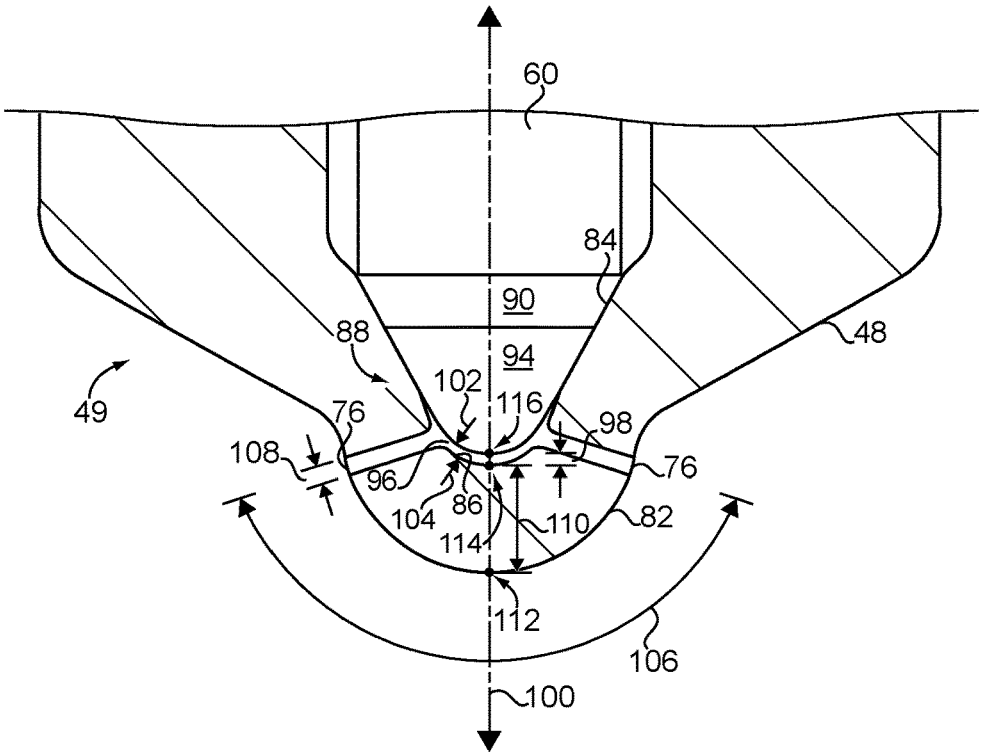
FIG. 3 is a partially sectioned view of a portion of a nozzle assembly, according to one embodiment.

Referring also now to FIG. 3, there is shown a sectioned side diagrammatic illustration of certain further details of nozzle assembly 49. Terminal end surface 94 may have a spherical shape that curves according to a convex radius of curvature 102, and sac surface 86 may also have a spherical shape that curves according to a concave radius of curvature 104. Each of terminal end surface 94 and sac surface 86 may be centered about longitudinal axis 100. In other words, a center point of a sphere defined by sac surface 86 and a center point of a sphere or hemisphere defined by terminal end surface 94 may each lie along longitudinal axis 100. In FIG. 3 it can be seen that a terminal end point 116 formed by terminal end surface 94 is intersected by longitudinal axis 100. Likewise, a sac surface center point 114 is intersected by longitudinal axis 100. An axial end point 112 defined by dome-shaped nozzle tip 82 is likewise intersected by longitudinal axis 100. Convex radius of curvature 102 and concave radius of curvature 104 may be sized such that a clearance 98 between terminal end surface 94 and sac surface 86 is nowhere less than along a line segment that extends between terminal end surface 94 and sac surface 86 and is collinear with longitudinal axis 100. The subject line segment in the FIG. 3 illustration could be a line segment connecting point 116 and point 114. Clearance 98 can be understood as the space itself between sac surface 86 and terminal end surface 94, although in FIG. 3 clearance 98 is shown as the corresponding dimension between those surfaces.

In an implementation, a size of convex radius of curvature 102 may be substantially equal to a size of concave radius of curvature 104. Terminal end surface 104 and sac surface 86 may be substantially parallel throughout at least a majority of sac cavity 96, such that clearance 98 between terminal end surface 94 and sac surface 86 is substantially uniform throughout sac cavity 96. Another way to understand this feature, is that throughout a proportion of sac cavity 96 greater than 50%, a distance separating terminal end surface 94 and sac surface 86 may be generally consistent. The size of clearance 98 might be uniform throughout, but in most designs will not be such that needle check 60 and nozzle body 48 approach one another anywhere along sac cavity 96 that is closer than the distance at the described line segment collinear with longitudinal axis 100.

In an implementation, the sizes of convex radius of curvature 102 and concave radius of curvature 104 may be about 0.05 inches or less, and clearance 98 may be about 0.01 inches or less. Convex radius of curvature 102 and concave radius of curvature 104 may further be about 0.04 inches, and clearance 98 may be about 0.009 inches. The significance of appropriate dimensioning and arrangement of surfaces forming sac cavity 96 or adjacent to sac cavity 96 will be further apparent from the following description. In an implementation, a volume of sac cavity 96 may be about 1.5 cubic millimeters or less, and in a refinement a volume of sac cavity 96 may be about 1.3 cubic millimeters.

It will be recalled that dome-shaped nozzle tip 82 may define axial end point 112. In an implementation, the sizing and shape of sac surface 86 affects a nozzle body wall thickness. A line segment extending from axial end point 112 to sac surface center point 114 can be understood to define a wall thickness of nozzle body 48. Wall thickness 110 may be greater than clearance 98 by a factor of about five or greater. In a refinement, wall thickness 110 may be greater than clearance 98 by a factor of about eight or greater, and may be about 0.08 inches. As used herein, the term "about" can be understood in the context of conventional rounding to a consistent number of significant digits. Accordingly, "about 1.5 millimeters" can be understood to mean from 1.45 millimeters to 1.54 millimeters. Analogously, "about 0.009 inches" can be understood to mean from 0.0085 inches to 0.0094 inches, and so on. A spray angle 106 defined by spray orifices 76 is further shown in FIG. 3, and may be about 145 degrees. An orifice diameter 108 defined by spray orifices 76 may be identical throughout or among spray orifices 76, and may be about 0.0166 inches.

INDUSTRIAL APPLICABILITY

Figure 4:
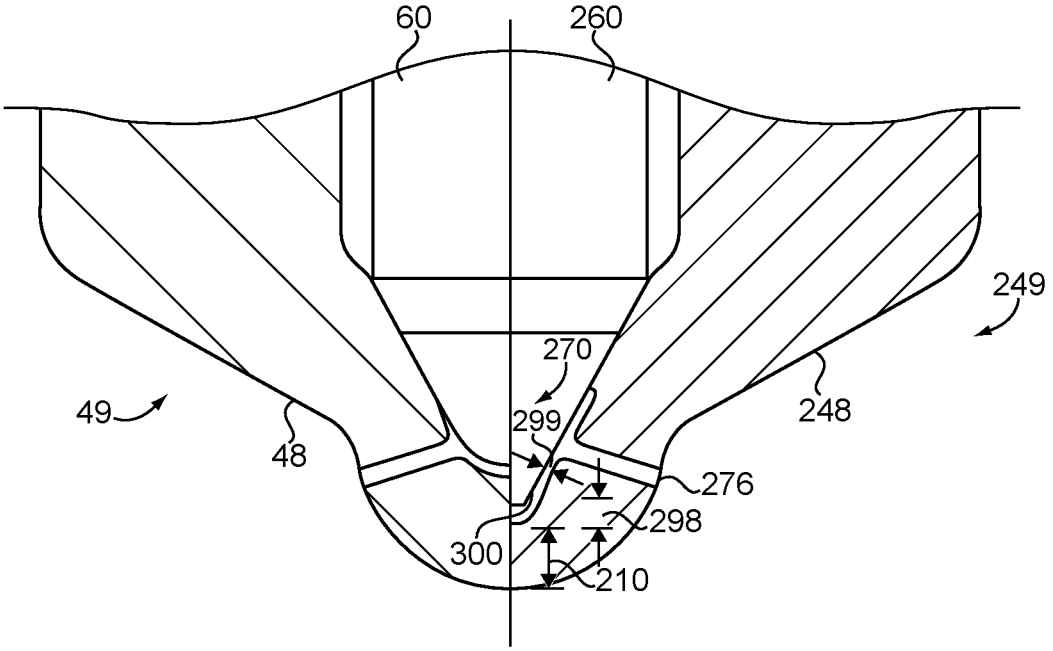
FIG. 4 is a partially sectioned side diagrammatic view comparing features of a nozzle assembly according to the present disclosure with a known design.

It will be recalled that the present disclosure is contemplated to offer a number of improvements over conventional strategies. Referring now to FIG. 4, there is shown on the left-hand side of the drawing a view of nozzle assembly 49, in comparison to a known design shown on the right-hand side of the drawing for a nozzle assembly 249. Nozzle assembly 249 includes a needle check 260 and a nozzle body 248 and has a number of functional analogies with nozzle assembly 49, but important differences. It will be recalled that clearance 98 in nozzle assembly 49 may be substantially uniform, and nowhere less than along longitudinal axis 100. In nozzle assembly 249 a clearance 299 between needle check 260 and nozzle body 248 is not uniform, and further can be expected to be smallest at locations outboard of what would be the longitudinal center axis of nozzle assembly 249. Rather than a spherical shape, a needle tip 270 of needle check 260 has a frustoconical shape, and forms relatively sharp corners, one of which is shown and depicted by way of reference numeral 300. A first clearance, in an axial direction between nozzle body 248 and needle check 260, is shown at reference numeral 298 and might be equal to about 0.01 inches or greater. A wall thickness 210 might be about 0.05 inches. A minimum clearance is shown at reference numeral 299, and may be about 0.005 inches, or less. It can be appreciated that sizes and shapes of the surfaces forming sac cavity 96 according to the present disclosure could provide a reduced volume, and a proportionally greater wall thickness resulting in improved resistance to impacts that might occur between a needle check and a nozzle body in some instances both because of the sac cavity shape and longer, more uniform clearance, as well as the greater wall thickness.

It should further be appreciated that certain other features of the present disclosure are retained with respect to nozzle assembly 249, including spray orifice size, arrangement, spray angle, and overall outer profile of the nozzle assembly. For this reason, nozzle assembly 49 and the fuel injector of which it is a part can be swapped in for nozzle assemblies and fuel injectors constructed analogously to or employing nozzle assembly 249 without any expectation of a change in performance or the need for other hardware changes or installation or mounting modifications.

Figure 5:
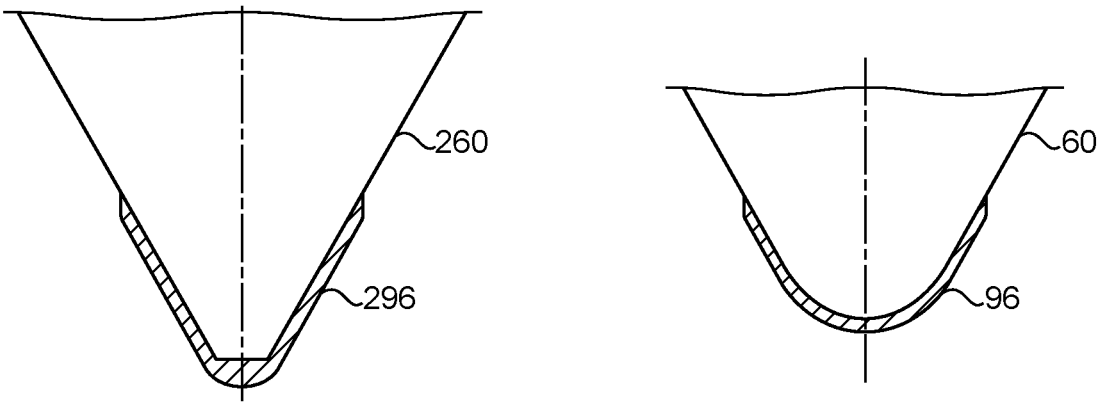
FIG. 5 is a diagrammatic view comparing a sac size and configuration in a nozzle assembly according to the present disclosure with a sac size and configuration in a known design.

Referring now to FIG. 5, there is shown needle check 260 in comparison with needle check 60, and illustrating sac cavity 296 in comparison with sac cavity 96. Sac cavity 296 of the known design can be seen to have a generally conical shape, characterized by straight sides and a relatively deep and narrowly profiled apex. In contrast, sac cavity 96 can be seen to have a different profile, with a more gradually arcing apex, and a shallower and more uniform depth throughout. While differences in sac volume can appear relatively minor, those skilled in the art will appreciate that a difference of less than a cubic millimeter can have effects on efficiency and emissions. Whenever a fuel injection event is terminated, a small amount of fuel can be left resident within the sac cavity. Over the course of many fuel injections, numbering in the millions or even billions, the quantities of fuel left in the sac cavity between injections and not combusted or incompletely combusted can be non-trivial. It has been observed that sac cavity volume is desirably as small as practicable, but in some instances it may be undesirable to eliminate the sac completely, as a solid landing of a needle check upon a nozzle body could be expected at least over time to increase a risk of fracturing of the needle check or nozzle body, beating-in of the needle check into the nozzle body. Achieving proper seating of a needle check upon a valve seat to shut off fuel flow to spray orifices could also be expected to be more difficult to achieve without a sac cavity. A sac volume of sac cavity 96 could be expected to be about 10% or greater less than a sac volume of sac cavity 296 in some instances. Finally, those skilled in the art will further appreciate that improvements in manufacturability might be obtained with the design of nozzle assembly 49, in particular since the profile of inner surface 80 as can be achieved with a single tool pass rather than more complex grinding operations as may be required with other geometries.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A nozzle assembly for a fuel injector comprising:

a nozzle body defining a longitudinal axis, and having an outer surface, an inner surface, and a dome-shaped nozzle tip, and having formed therein a nozzle outlet passage;

the inner surface including a seat surface extending circumferentially around the longitudinal axis and located axially inward of the dome-shaped nozzle tip, and a sac surface located at least predominantly within the dome-shaped nozzle tip;

the dome-shaped nozzle tip having formed therein a plurality of spray orifices distributed about the longitudinal axis and extending from a plurality of inlet locations within the sac surface to a plurality of outlet locations within the outer surface;

a needle check positioned for reciprocation within the nozzle body and defining an axis of reciprocation that is collinear with the longitudinal axis, the needle check having a first end that includes a closing hydraulic surface and an opening hydraulic surface, and a second end that includes a needle tip having a sealing surface and a terminal end surface located axially outward of the sealing surface;

the sealing surface being positioned in contact with the seat surface such that the needle check blocks the nozzle outlet passage from fluid communication with the plurality of spray orifices, and the terminal end surface being positioned in spaced, facing relation to the sac surface, such that a sac cavity extends between the needle check and the nozzle body; and the terminal end surface is spherically shaped and curves according to a convex radius of curvature, and the sac surface is spherically shaped and curves according to a concave radius of curvature, the outer surface is concave upon the dome-shaped nozzle tip;

the sac surface comprising two concave surfaces with equivalent radii of curvature mating with a convex sac;

the sac surface cooperating with the terminal end surface to form a sac volume, wherein the sac surface is inclusive of the plurality of spray orifices; and each of the terminal end surface and the sac surface is centered about the longitudinal axis, and the convex radius of curvature and the concave radius of curvature are sized such that a clearance between the terminal end surface and the sac surface is nowhere less than a distance along a line segment that extends between the terminal end surface and the sac surface and is collinear with the longitudinal axis.

2. The assembly of claim 1 wherein the size of the convex radius of curvature is substantially equal to the size of the concave radius of curvature, and wherein the terminal end surface and the sac surface are substantially parallel throughout at least a majority of the sac cavity, such that the clearance between the terminal end surface and the sac surface is substantially uniform throughout the sac cavity.

3. The assembly of claim 2 wherein the size of the convex radius of curvature and the size of the concave radius of curvature are each about 0.05 inches or less, and the clearance is about 0.01 inches or less.

4. The assembly of claim 3 wherein the size of the convex radius of curvature and the size of the concave radius of curvature are each about 0.04 inches, and the clearance is about 0.009 inches.

5. The assembly of claim 3 wherein a volume of the sac cavity is about 1.5 cubic millimeters or less.

6. The assembly of claim 5 wherein the volume of the sac cavity is about 1.3 cubic millimeters.

7. The assembly of claim 1 wherein the dome-shaped nozzle tip defines an axial end point of the nozzle body, and the sac surface defines a sac surface center point, and wherein a line segment extending from the axial end point to the sac surface center point defines a wall thickness of the nozzle body, and the wall thickness is greater than the clearance by a factor of about five or greater.

8. The assembly of claim 7 wherein the wall thickness is greater than the clearance by a factor of about eight or greater.

9. The assembly of claim 8 wherein the wall thickness is about 0.08 inches.

10. A fuel injector for an internal combustion engine comprising:

a nozzle body defining a longitudinal axis and having formed therein a plurality of spray orifices, and a nozzle outlet passage extending between a fuel inlet and the plurality of spray orifices;

an injection control mechanism including a needle check positioned for reciprocation within the nozzle body;

the nozzle body having an outer surface, an inner surface, and a dome-shaped nozzle tip centered about the longitudinal axis;

the inner surface including a seat surface extending circumferentially around the longitudinal axis and located axially inward of the dome-shaped nozzle tip, and a sac surface located at least predominantly within the dome-shaped nozzle tip and centered about the longitudinal axis;

the plurality of spray orifices being formed within the dome-shaped nozzle tip and extending from a plurality of inlet locations within the sac surface to a plurality of outlet locations within the outer surface;

the needle check having a first end, and a second end that includes a needle tip having a sealing surface and a terminal end surface located axially outward of the sealing surface;

the sealing surface being positioned in contact with the seat surface such that the needle check blocks the nozzle outlet passage from fluid communication with the plurality of spray orifices, and the terminal end surface being positioned in spaced, facing relation to the sac surface, such that a sac cavity extends between the needle check and the nozzle body;

the terminal end surface is spherically shaped and curves according to a convex radius of curvature, the sac surface is spherically shaped and curves according to a concave radius of curvature, and the outer surface is concave upon the dome-shaped tip;

the sac surface comprising two concave surfaces with equivalent radii of curvature mating with a convex sac;

the sac surface cooperating with the terminal end surface to form a sac volume, wherein the sac surface is inclusive of the plurality of spray orifices; and a clearance extends between the terminal end surface and the sac surface, and the clearance having a size throughout the sac cavity that is equal to or greater than a size of the clearance along a line segment that is collinear with the longitudinal axis.

11. The fuel injector of claim 10 wherein the needle check is in a closed position, and further comprising a biasing spring biasing the needle check toward the closed position.

12. The fuel injector of claim 10 wherein the plurality of spray orifices extend between the plurality of inlet locations within the sac surface and outlet locations within the outer surface.

13. The fuel injector of claim 10 further comprising a fuel pressurization mechanism coupled with the nozzle body, and including a tappet structured for actuating by way of rotation of a cam.

14. The fuel injector of claim 10 wherein the clearance is substantially uniform throughout the sac cavity.

15. The fuel injector of claim 14 wherein the clearance is less than 0.01 inches.

16. The fuel injector of claim 15 wherein the clearance is about 0.009 inches, and a volume of the sac cavity is about 1.3 cubic millimeters.

17. The fuel injector of claim 10 wherein the dome-shaped nozzle tip defines an axial end point of the nozzle body, and the sac surface defines a sac surface center point, and wherein a line segment extending from the axial end point to the sac surface center point defines a wall thickness of the nozzle body, and the wall thickness is greater than the clearance by a factor of about five or greater.

18. The fuel injector of claim 17 wherein the wall thickness is about 0.08 inches, and is greater than the clearance by a factor of about eight.

* * * * *